United States Patent [19]

Demuth

[11] 4,346,500

[45] Aug. 31, 1982

[54] SPINNING PREPARATORY MACHINE

[75] Inventor: Robert Demuth, Wallisellen, Switzerland

[73] Assignee: Rieter Machine Works Ltd., Winterthur, Switzerland

[21] Appl. No.: 159,669

[22] Filed: Jun. 16, 1980

[30] Foreign Application Priority Data

Jul. 4, 1979 [CH] Switzerland ..... 6407/79

[51] Int. Cl.[3] ..... D01G 15/40; D01G 15/76

[52] U.S. Cl. ..... 19/105; 19/107

[58] Field of Search ..... 19/105, 107

[56] References Cited

U.S. PATENT DOCUMENTS 3,034,179 5/1962 Hall ..... 19/105
3,315,320 4/1967 Bass et al. ..... 19/107
4,064,598 12/1977 Katoh et al. ..... 19/107
4,135,275 1/1979 Gunter ..... 19/107

FOREIGN PATENT DOCUMENTS 4518050 11/1966 Japan ..... 19/107

*Primary Examiner*—Louis Rimrodt
*Attorney, Agent, or Firm*—Werner W. Kleeman

[57] ABSTRACT

The converging space between the moving-in or inbound surface of a loosening roll and the surface of a feed roll contains a suction duct, which is brought into close vicinity of the fibre loosening zone located between the two rolls, and which is used for sucking off of dust released in this zone. The suction duct is supported by the body forming the fibre feeder trough. Detrimental deposits of impurities in the subsequent processes, e.g. in the open-end spinning rotors, thus are greatly reduced.

6 Claims, 2 Drawing Figures

SPINNING PREPARATORY MACHINE

BACKGROUND OF THE INVENTION

The present invention concerns a spinning preparatory machine, in particular a card, with a feeder roll including a body supporting the feeder trough coordinated thereto, a loosening roll provided with points or tips, and with a loosening zone for the fibre material, located between the feeder roll and the loosening roll, and with a suction device located in the converging space formed between the incoming or inbound surface of the loosening roll and the surface of the feeder roll.

In staple fibre yarn spinning the open-end spinning method has found increasing acceptance since this method is more economical in certain yarn count ranges in comparison to the older ring spinning method. In processing natural fibres especially, the open-end spinning method, however, shows the disadvantage, that it reacts susceptibly to the trash present in the fibre slivers to be fed. Mainly the contaminations consisting of micro dust and short fibres are accumulated during the spinning process on the inside rotor wall to which they adhere, which results in the formation of an increasingly uneven yarn and finally results in yarn breakages.

There is no lack of attempts to effectively eliminate contamination of the fibre material in opening and cleaning and in carding. These measures, however, are not sufficient to reach the low content of contaminations, required for open-end spinning, in the fibre material.

In a known card (GB-PS No. 791,339) an air supply opening merges, seen in the direction of rotation of the loosening roll (licker-in or taker-in roll), after the trough nose around which the fibre layer is supplied, through which air supply opening air is sucked into the interior of the perforated loosening roll. The air flowing in the direction towards the loosening roll causes the fibre material already taken over by the licker-in or taker-in roll and stored on its clothing to be pressed into the clothing and to be condensed there, in such manner that the contamination is retained therein.

Also known already in this art is a suction device on cards (DE-AS No. 1,685,552), in which immediately above the feeder roll a suction hood with a suction slot facing the licker-in roll is arranged. The hood is provided for sucking off the fibres clinging to the fluted or knurled feeder roll, the feeder roll being subject to an air flow from both sides, flowing into the hood. Furthermore, only the fibres released by the sharp deflection of the fibre layer supplied at the end of the feeder table trough are to be sucked off using the suction slot, which is desirable in view of their reusability or reworkability. On the other hand, however, a suction device of this type does not permit elimination of contaminations and dust freed from the fibre material during passage over the loosening roll, as the fibre layer, deflected sharply at the end of the trough in the direction of rotation, here widens up or enlarges and forms a throttle. This reduces the effectiveness of the suction stream up to the loosening zone too much, as the latter is located considerably below the deflection point.

SUMMARY OF THE INVENTION

It thus is an object of the present invention to eliminate the disadvantages cited and to free the fibre material as effectively as possible from dust, which detrimentally influences subsequent processing, and to prevent it from freely escaping into the atmosphere of the plant room.

This object is achieved in that the feeder trough body extends into the converging space up to the loosening zone and that a suction opening of the suction device opens onto the zone.

In applying these measures, the suction air stream is caused to develop its full effect directly above the loosening zone, and owing to the vacuum prevailing there no build up of static pressure is possible, which could permit lateral escape of contaminated air carried on by the suction air stream.

The suction opening can be formed on one hand, by a nose extending along the feeder trough up to the loosening zone and, on the other hand, by a trough plate extending at a distance and protruding less far.

This embodiment is advantageous in that in this arrangement the suction air stream can enter directly at the nose, which increases its effectiveness, and in that a very simple design is possible.

A further embodiment consists in that the loosening zone which is formed by using a further loosening roll is connected with the suction device via a duct formed between a cover and the surface of the first loosening roll. This makes it possible to take care of a further source of dust without further complications, such as special ducts or cover hoods.

The feeder trough body in advantageous manner can contain air passage openings lined up or extending in a row over the length of the feeder trough, and ending at the suction opening, which air passage openings merge into a common air exhaust housing. This proves advantageous, as it improves the distribution and stabilization of the suction stream within the body in such manner that the suction action is effective at all places evenly.

In a further embodiment of the invention the feeder trough body including the suction device can be removed as a unit from the feeder roll along a rigid pathway or fixed path. This permits freeing of the converging space or room between the rolls in an operationally simple manner for maintenance purposes and for inspecting and cleaning the passage openings in the body.

BRIEF DESCRIPTION OF THE DRAWINGS

The invention is described in greater detail in the following with reference to illustrated design examples. It is shown in.

DETAILED DESCRIPTION OF THE PREFERRED EMBODIMENTS

Figure 1:
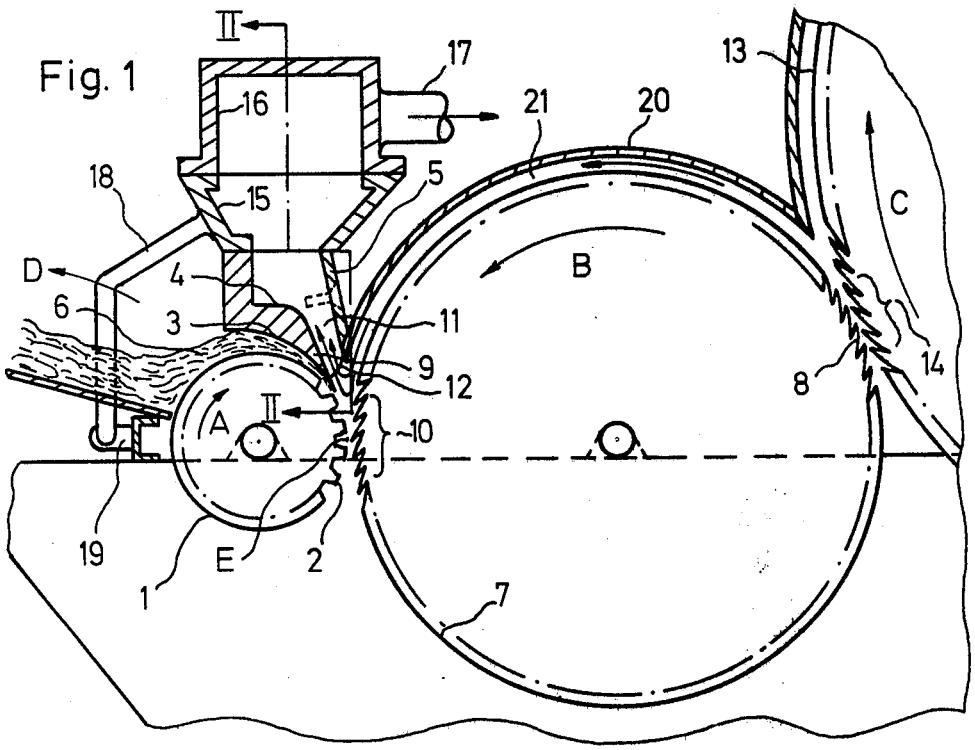
FIG. 1 a section along line I—I according to FIG. 2 of a card with a contamination suction arrangement.

A feeder roll 1 (FIG. 1) is fluted or knurled on its outer or sleeve surface or provided with coarse teeth, tips or points 2 or similar elements and can be driven in the direction of arrow A. A feeder trough 3 located above the feeder roll 1 and which is worked into or machined at a trough body 4, and a trough plate 5 mounted thereon extend mutually parallel in axial direction. Between the feeder roll 1 and the trough 3 the fibre material 6 to be transported is placed e.g. in form of a fibre layer from e.g. a picker lap. A loosening roll 7 is provided with fine teeth or points 8 respectively, and can be driven in the direction of arrow B, i.e. opposite to the direction of rotation of the feeder roll 1. In operation the surface or circumferential speed of the roll 7 is much higher than that of roll 1. The trough body 4 comprises a nose 9 extending almost up to the point of the smallest distance E of the two rolls 1 and 7. Between this nose 9 and the trough plate 5 which extends somewhat less far, i.e. in the converging space between the cylindrical surface of the loosening roll 7 rotating towards a loosening zone 10 and the cylindrical surface of the feeder roll 1 also moving towards the loosening zone, there is located an air exhaust duct 11 having the suction opening 12. In the loosening zone 10, which begins somewhat in front of the point E between the loosening roll 7 facing this point directly and the feeder roll 1, the fibre material 6 supplied is taken up and loosened in the process. Immediately upon release by the trough 3 the previously extensively compressed material widens or enlarges to about 10 to 20 times its previous thickness (e.g. to 5 to 10 mm), is combed in this state at high speed in the range of 8 to 18 m/sec, releases dust in the process and is transferred furthermore to the roll 7. Subsequently the loosening roll 7 also co-operates with drum 13, which is provided with still finer teeth or points and acts as a second loosening roll, of e.g. a card, which in FIG. 1 is not shown completely, which rotates in the direction of the arrow C. The increasing lengths of the arrows A, B, C indicate that the circumferential speed of each successive roll exceeds that of the preceding one. Between the rolls 7 and 13 a second loosening zone 14 is formed, in which the fibres are transferred to the drum 13. Also here dust is released.

A suction arrangement comprises, in addition to the air exhaust or suction duct 11 formed by the trough body 4 and the trough plate 5, an air exhaust housing 15 adjacent thereto, which extends along the feeder trough 3, to which housing 15 a suction duct 16 of about the same length is connected, which distributes the vacuum, the duct 16 being connected via a flexible or extendable duct 17 with a vacuum generator or source (not shown). The trough body 4, the air exhaust housing 15 and the suction duct 16 are integrated into a unit and are supported by supporting arms 18 (one of which only is visible in FIG. 1), which are pivotable about a bearing 19 rigidly mounted to the machine frame, i.e. the unit can be moved away on a rigid pathway. During operation the unit of course is fixed and secured (not shown) relative to the machine frame. By pivoting the support arm 18 counterclockwise (arrow D) the trough body 4 together with the elements 15, 16 can be tilted away from the feeder roll 1. This permits easy access to the elements 1, 3, 7 and 11, e.g. for the purpose of inspecting and cleaning them.

Extending from the second loosening zone 14 is a cover 20, which, while closely hugging the loosening roll 7, extends in the direction of rotation over the roll 7 up to the plate 5 on which it is supported sealingly. Together with the roll 7 the cover 20 forms a connecting duct 21 between the suction opening 12 of the air exhaust or suction duct 11 and the second loosening zone 14.

Figure 2:
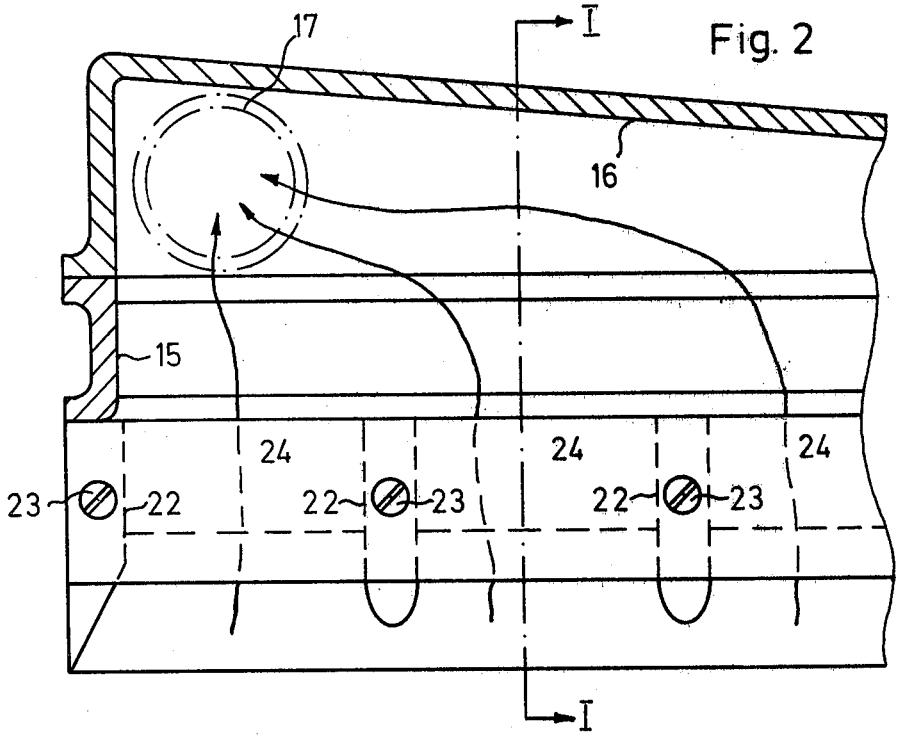
FIG. 2 a section along line II—II according to FIG. 1.

At suitable mutual distances the trough body 4 is provided with holding members 22 (FIG. 2) in rib form. Onto these the trough plate 5 is detachably mounted using screws 23. The air exhaust or suction duct 11 thus is subdivided along the feeder trough 3 into a plurality of individual air passage openings 24, each of which is laterally limited by two neighbouring holding members 22. All air passage openings 24 extend at an angle between the body 4 and the plate 5 to the air exhaust housing 15.

During operation the fibre material 6 is pressed by the feeder roll 1 into the trough 3, from which it is released such that it widens or expands under the influence of its inherent elasticity. In the loosening zone 10 it then is loosened by the roll 7 and is drawn out. During this process a substantial portion of the impurities or contaminations present in the fibre material 6, particularly fine dust (micro dust), clinging thereto, is released. Impurities not yet released are loosened in the fibre material 6 to such an extent that in one of the subsequent loosening zones they can be released. The air carried on by the rapidly rotating cylindrical surface of the loosening roll 7 in the duct 21 at the loosening zone 10 is prevented from passing the narrowest point E between the two rolls, owing to the small distance between the surfaces of the two rolls 1 and 7 and the expanded fibre material placed therebetween. The impurities released thus are caught by the suction air stream from the suction opening 12 and subsequently are eliminated with the air moved through the suction duct 11 and the suction arrangement formed by the elements 15, 16 and after filtering out the impurities are exhausted.

It proves advantageous if the suction action generated at the suction opening 12 is of such strength that the air supplied to the loosening zone 10 between the loosening roll 7 and the cover 20 is sucked off completely, as in this case a build-up of static pressure in front of the loosening zone 10, and thus an axial flow and lateral escape of contaminated air into the plant room can be avoided, and a special seal can be dispensed with, respectively.

During the transfer from the loosening roll 7 to the drum 13 in the loosening zone 14 the fibre material is loosened once more, during which process further impurities possibly preloosened earlier already, are now released. These impurities thus are carried on by the air stream flowing in the connecting duct 21 and after being sucked into the duct 11 also are eliminated by the suction arrangement (elements 15, 16). A separate duct outside the cover 20 thus can be dispensed with.

The inventive apparatus proves advantageous in that the feeder trough 3 used for feeding the fibres extends by means of a trough body 4 in which a duct is provided from above into the converging space or room between the feeder roll 1 and the loosening roll 7, e.g. the licker-in or taker-in roll of a card, and that the suction opening of this duct 11 thus is brought into close vicinity to the point where dust is released. At the same time lateral escape of the contaminated air carried on by the loosening roll is decisively reduced or completely prevented using this arrangement.

The invention provides a spinning preparatory machine comprising a feeder roll, a fibre loosening roll which removes fibre material from the feeder roll and a suction device extending into the convergent space between the rolls, so that the device opens onto a loosening zone between the rolls. The device can be integrated with a feeder member which co-operates with the feeder roll; the suction device can be on the side of the feeder member facing away from the feeder roll.

While there are shown and described present preferred embodiments of the invention, it is to be distinctly understood that the invention is not limited thereto, but may be otherwise variously embodied and practiced within the scope of the following claims. Accordingly,

What I claim is:

1. A spinning preparatory machine, especially a card, comprising:

a feeder roll;

means defining a feeder trough operatively associated with said feeder roll for receiving fibre material therebetween which has been infed between said feeder roll and said feeder trough;

a loosening roll provided with tip means;

said loosening roll and feeder roll coacting with one another so as to define therebetween a loosening zone for the fiber material;

a suction device located in a converging space formed between an inbound surface of the loosening roll and a surface of the feeder roll;

the feeder roll having a predetermined direction of rotation;

said loosening roll having a predetermined direction of rotation;

said predetermined direction of rotation of said feeder roll and said predetermined direction of rotation of said loosening roll being in the same rotational sense at the region of said converging space;

said means defining said feeder trough including a feeder trough body;

said suction device having a suction opening; and said feeder trough body and said suction opening extending into the converging space up to the region of said loosening zone.

2. The spinning preparatory machine as defined in claim 1, further including:

a trough plate cooperating with said feeder trough for delimiting therebetween said suction opening;

said feeder trough having a nose portion which together with said trough plate forms said suction opening;

said nose portion extending along said feeder trough up to the vicinity of said loosening zone; and said trough plate extending in spaced relationship from said nose portion and protruding to a lesser extent towards the vicinity of said loosening zone than said nose portion.

3. The spinning preparatory machine as defined in claim 1, further including:

a further loosening roll arranged immediately following said loosening roll;

said further loosening roll and said loosening roll forming therebetween a further loosening zone;

means defining a duct;

said duct defining means comprising a cover arranged over said loosening roll and forming between a surface of said loosening roll and said cover said duct; and said further loosening zone being connected with said suction device by means of said duct.

4. The spinning preparatory machine as defined in claim 1, wherein:

said feeder trough body is provided with a plurality of air passage openings which are arranged in a row and extend along said feeder trough;

said air passage openings terminating at said suction opening; and said suction device including means defining a common air exhaust housing at which merge said air passage openings.

5. The spinning preparatory machine as defined in claim 4, further including:

a trough plate cooperating with said feeder trough for delimiting therebetween said suction opening;

said feeder trough having a nose portion which together with said trough plate forms said suction opening;

said nose portion extending along said feeder trough up to the vicinity of said loosening zone; and said trough plate extending in spaced relationship from said nose portion and protruding to a lesser extent towards the vicinity of said loosening zone than said nose portion;

support members provided for said feeder trough body;

said trough plate being detachably mounted at said support members;

said support members being arranged at a mutual spacing from one another and protruding towards said trough plate such that there is formed between each two neighboring support members one of said air passage openings.

6. The spinning preparatory machine as defined in claim 1, further including:

means enabling said feeder trough body and said suction device to be moved as a unit away from said feeder roll along a fixed path of travel.

* * * * *